US010480137B2

(12) United States Patent
Jiang et al.

(10) Patent No.: US 10,480,137 B2
(45) Date of Patent: Nov. 19, 2019

(54) FLEXIBLE CABLE CONNECTING STRUCTURE AND BRIDGE STRUCTURE

(71) Applicant: SHENZHEN MUNICIPAL DESIGN & RESEARCH INSTITUTE CO., LTD., Shenzhen, Guangdong (CN)

(72) Inventors: Ruijuan Jiang, Shenzhen (CN); Yiyan Chen, Shenzhen (CN); Fang Yu, Shenzhen (CN); Qiming Wu, Shenzhen (CN); Jucan Dong, Shenzhen (CN)

(73) Assignee: Shenzhen Municipal Design & Research Institute Co., Shenzhen, Guangdong (CN)

( * ) Notice: Subject to any disclaimer, the term of this patent is extended or adjusted under 35 U.S.C. 154(b) by 0 days.

(21) Appl. No.: 16/079,985

(22) PCT Filed: Feb. 24, 2017

(86) PCT No.: PCT/CN2017/074685
§ 371 (c)(1),
(2) Date: Aug. 24, 2018

(87) PCT Pub. No.: WO2018/086273
PCT Pub. Date: May 17, 2018

(65) Prior Publication Data

US 2019/0063016 A1 Feb. 28, 2019

(30) Foreign Application Priority Data

Nov. 9, 2016 (CN) ..... 2016 1 0984753

(51) Int. Cl.
*E01D 4/00* (2006.01)
*E01D 19/16* (2006.01)
*E01D 11/02* (2006.01)
*E01D 19/14* (2006.01)

(52) U.S. Cl.
CPC ..... *E01D 19/16* (2013.01); *E01D 11/02* (2013.01); *E01D 19/14* (2013.01)

(58) Field of Classification Search
CPC ..... E01D 4/00; E01D 11/02; E01D 19/16
USPC ..... 14/18, 21, 22
See application file for complete search history.

(56) References Cited

U.S. PATENT DOCUMENTS 6,814,523 B1 * 11/2004 Nilsson ..... F16G 11/08 14/22
2002/0104175 A1 * 8/2002 Zivanovic ..... E01D 19/16 14/22

* cited by examiner

*Primary Examiner* — Raymond W Addie
(74) *Attorney, Agent, or Firm* — Lathrop Gage LLP

(57) ABSTRACT

A flexible cable connecting structure and a bridge structure. The connecting structure includes a flexible cable; the first portion connected to a top end and a second portion connected to a bottom end by using a spherical bearing pair. By using a hinge assembly and a spherical hinge assembly, a rotatable connection between the cable and a bridge structure is implemented to avoid force uniformity of steel wires inside the cable due to inclination, thus helps prolong the service life of the cable. The connecting ends of the cable are located in a lower part of an arch rib and an upper part of a bridge floor, respectively located within a line of sight range, making it convenient for maintenance. The cable can be prefabricated in a factory, which ensures construction quality and reduces time of site construction.

8 Claims, 5 Drawing Sheets

FLEXIBLE CABLE CONNECTING STRUCTURE AND BRIDGE STRUCTURE

TECHNICAL FIELD

The present invention relates to the field of construction engineering, and in particular, to a cable structure that is easy to maintain and replace.

BACKGROUND

It can be found from current survey data that damage to cable bridges is mostly caused due to cable failure. A cable in the cable bridges is used as a main force transmission component. Fracture of one or more cables easily causes bridge collapse. Therefore, cable safety has important significance to safety of the entire bridge.

There is usually a rigid connection between an existing cable structure and an arch rib and a beam. When the cable is deformed and inclined due to impact of temperature or other factors, force uniformity of steel wires inside the cable is affected. If this case lasts for a long time, some steel wires are fractured, thereby reducing the service life of the cable, even causing an accident in serious cases.

In addition, two ends of the cable structure are usually anchored in invisible positions, such as above the arch rib and under the beam. During maintenance of an anchor end, a track maintenance car is required. However, partial space under the beam is relatively narrow, and a track car is difficult to pass through, so that the anchor end becomes a blind zone of maintenance, thereby greatly affecting safety of a bridge.

SUMMARY

To overcome disadvantages of the existing technology the present invention provides a flexible cable connecting structure.

The present invention further provides a bridge structure.

To resolve existing technical problems, the present invention provides the following technical solutions:

A flexible cable connecting structure, including a flexible cable and further including a first connecting portion connected to a top end of the flexible cable and a second connecting portion connected to a bottom end of the flexible cable, where the cable is rotatably connected to the first connecting portion and the second connecting portion, and is connected to at least one of the first connecting portion and the second connecting portion by using a spherical bearing pair.

As a further improved manner of the above solution, the first connecting portion includes a hinge assembly rotating along one direction or a spherical hinge assembly rotating along multiple directions, and the second connecting portion includes a spherical hinge assembly rotating along multiple directions.

As a further improved manner of the above solution, the spherical hinge assembly includes a spherical hinge cushion block and an anchoring beam, the anchoring beam is provided with a through hole, one end of the through hole includes a taper hole, the other end of the through hole includes a groove, the spherical hinge cushion block is provided with an arc-shaped protrusion matching a curvature diameter of the groove, an end part of the cable is inserted from the taper hole and is connected to the spherical hinge cushion block after passing through the through hole, and the protrusion is embedded into the groove to form the spherical bearing pair.

As a further improved manner of the above solution, the flexible cable connecting structure includes an anchoring nut, where an end part of the cable is provided with a screw anchor cup, the screw anchor cup passes through the spherical hinge cushion block, and the anchoring nut is in threaded connection with the screw anchor cup.

As a further improved manner of the above solution, the flexible cable connecting structure includes a pressure sensor, where the pressure sensor is disposed between the anchoring nut and the spherical hinge cushion block.

As a further improved manner of the above solution, the cable includes a steel strand and a protective casing disposed outside the steel strand.

As a further improved manner of the above solution, a screw anchor cup is sleeved outside an end part of the cable, and an annular seal ring is disposed between the screw anchor cup and an outer wall of the protective casing.

As a further improved manner of the above solution, the first connecting portion and the second connecting portion each include a connecting assembly, and the connecting assembly includes a pre-embedded anchoring element, or the connecting assembly includes a steel ring.

As a further improved manner of the above solution, the connecting assembly of the first connecting portion includes the pre-embedded anchoring element, the connecting assembly of the second connecting portion includes the steel ring and a hoop steel plate, and the steel ring is disposed at two ends of the hoop steel plate, and is coaxial with the hoop steel plate.

A bridge structure, including an arch rib and a beam, and further including the flexible cable connecting structure according to claim 9, a bottom end thereof is pre-embedded inside the beam by using the pre-embedded anchoring element, a top end thereof is sleeved on the arch rib by using the steel ring and the hoop steel plate, so that an anchoring end of the cable is within a visual range, and the steel ring and the arch rib are fixed as a whole by using several rivets.

The beneficial effects of the present invention are:

1. By using a hinge assembly and a spherical hinge assembly, a rotatable connection between a cable and a bridge structure is implemented, so as to avoid force uniformity of steel wires inside the cable caused due to incline and deformation of the cable, and help to prolong the service life of the cable.

2. Connecting ends of the cable are located in a lower part of an arch rib and an upper part of a bridge floor, respectively. Because the connecting ends are located within a line of sight range, it is convenient for maintenance, a blind zone of maintenance can be eliminated, and a problem that a cable is corroded in a beam due to that water inflows to an anchor head (or a seal box) used for anchoring the inhaul cable, thereby greatly improving safety of the bridge.

3. The cable and a connecting assembly thereof can be prefabricated in a factory. This can ensure construction quality, and can reduce time of site construction, help to shorten a construction period, and improve efficiency.

BRIEF DESCRIPTION OF THE DRAWINGS

The following describes the present invention in detail with reference to the accompanying drawings and specific embodiments.

DETAILED DESCRIPTION

The following describes a concept, a specific structure, and technical effects of the present invention clearly and completely with reference to embodiments and accompanying drawings, to fully understand an objective, solutions, and effects of the embodiments of the present invention. It should be noted that features in the embodiments and the embodiments in the application may be combined with each other in a non-conflicting situation.

It should be noted that, unless otherwise specified, when it is described that a feature is "fixed" and "connected" to another feature, the feature is directly "fixed" and "connected" to the another feature, or the feature is indirectly "fixed" and "connected" to the another feature. In addition, descriptions about top, bottom, left, right, and the like used in the present invention are provided only relative to a mutual position relationship of constituent parts of the present invention.

In addition, unless otherwise specified, meanings of all technical and scientific terms used in this specification are the same as that usually understood by persons skilled in the art. Terms used in this specification are only used to describe specific embodiments, but are not intended to limit the present invention. A term "and/or" used in this specification includes any combination of one or more related items listed.

Figure 1:
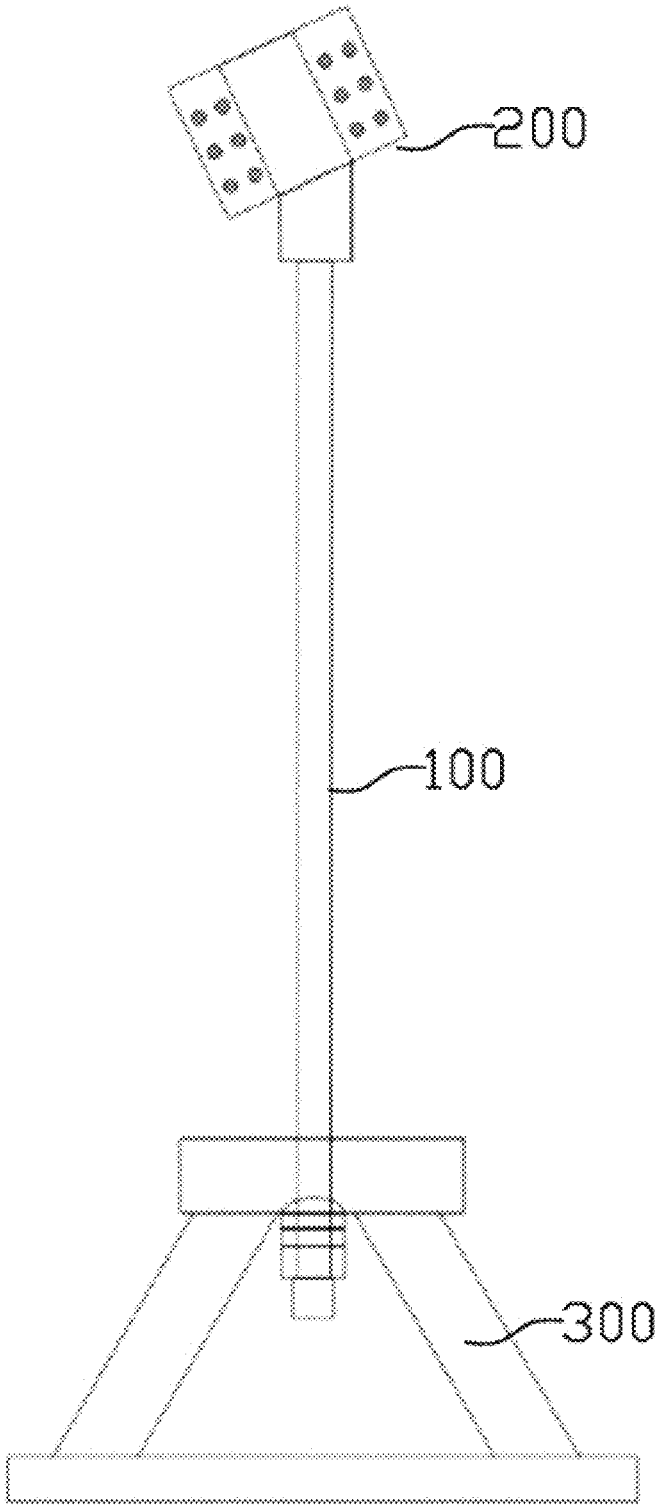
FIG. 1 is a front view of an embodiment of a flexible cable connecting structure according to the present invention.

Referring to FIG. 1, FIG. 1 is a front view of an embodiment of a flexible cable connecting structure according to the present invention. The cable structure mainly includes three parts: a flexible cable 100, a first connecting portion 200, and a second connecting portion 300, where the first connecting portion and the second connecting portion are connected to a top end and a bottom end of the cable 100, respectively, and are configured to implement a connection between the cable 100 and a bridge; the cable 100 is rotatably connected to the first connecting portion 200 and the second connecting portion 300, and is connected to at least one of the first connecting portion and the second connecting portion by using a spherical bearing pair, that is, there is a relatively high degree of freedom between the relative connecting portions of the cable 100. In this way, stress release is performed through rotation when the cable is deformed and inclined, thereby avoiding phenomenon of fracture of steel wires inside the cable. In this embodiment, the cable 100 is connected to the second connecting portion 300 by using the spherical bearing pair.

The flexible cable in the present invention mainly includes a steel strand and a protective casing disposed outside the steel strand, where the protective casing preferably uses a PE protective casing, to prevent the steel strand from being corroded and damaged by the outside environment. Adhesive tape winding the steel strand is disposed between the steel strand and the protective casing. In addition, an anchor cup provided with a screw is sleeved outside an end part of the cable. The screw anchor cup is configured to implement a connection between the following anchoring nut and the cable. Further, an annular seal ring is disposed between the screw anchor cup and an outer wall of the protective casing. The seal ring can prevent corrosion caused by rainwater at a joint part of the cable. A manner of anchoring the steel strand and an anchor head may alternatively be a conventional anchoring manner, such as using a clamp anchor or by using an extruding anchor.

Figure 2:
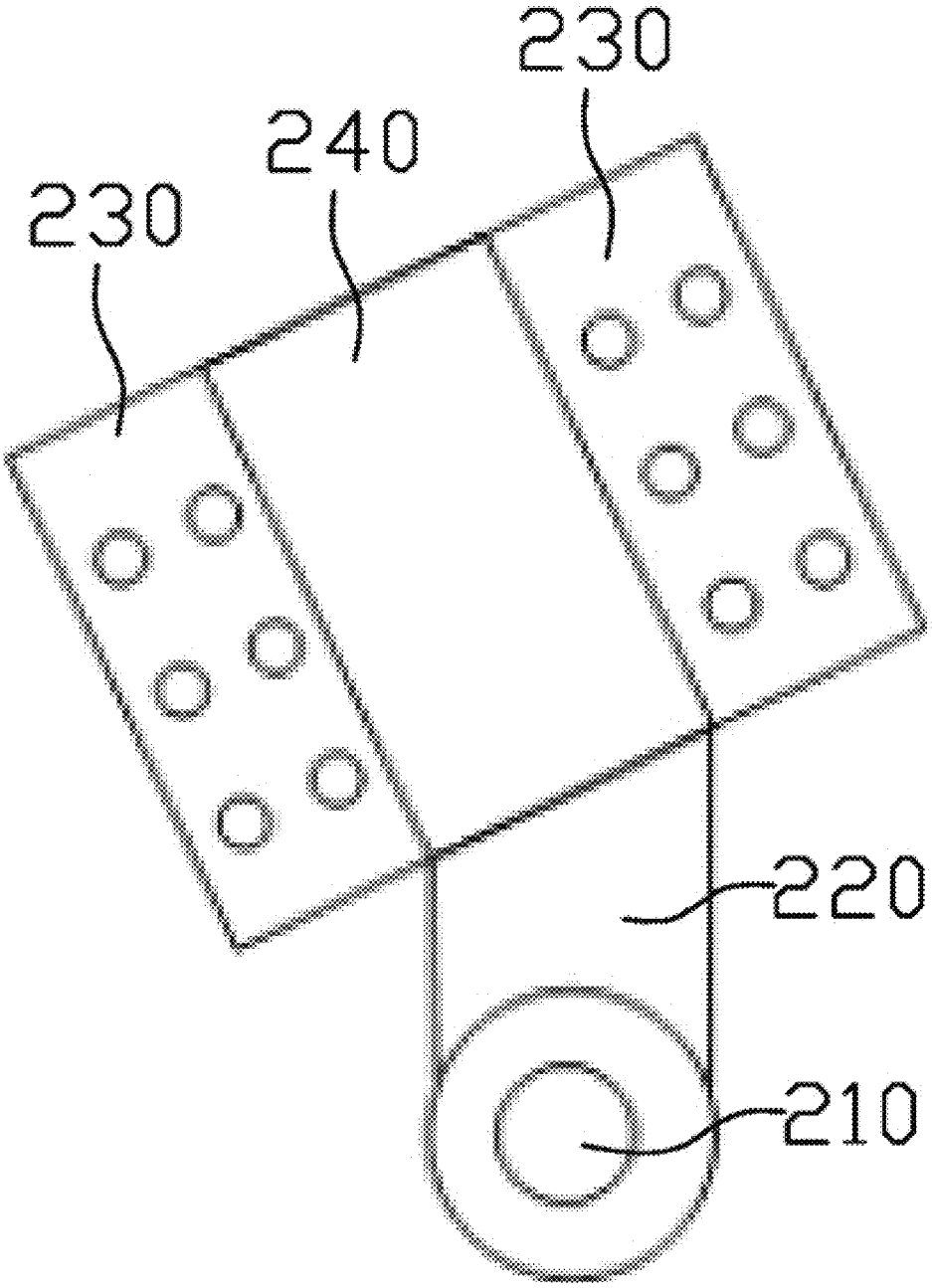
FIG. 2 is a front view of an embodiment of a first connecting portion according to the present invention.

Referring to FIG. 2, FIG. 2 is a front view of an embodiment of a first connecting portion according to the present invention. As shown in the figure, the first connecting portion includes a rotation shaft 210, a connecting assembly 220, a steel ring 230, and a hoop steel plate 240, where the rotation shaft 210 and the connecting assembly 220 form a hinge assembly, and a top end of the cable 100 is connected to the rotation shaft 210, so that the cable 100 can rotate along one direction in a reciprocating manner relative to the first connecting portion; and the connecting assembly 220 is configured to implement a connection between the rotation shaft 210 and the hoop steel plate 240.

The steel ring 230 and the hoop steel plate 240 form the connecting assembly of the first connecting portion and are configured to implement a connection between the first connecting portion and a bridge, where the hoop steel plate 240 is preferably a U-shaped steel plate, and an opening of the hoop steel plate 240 faces downwards. The steel ring 230 may be used as a detachable structure to clamp the hoop steel plate 240 in the middle, or may be fastened to the hoop steel plate 240 to form an integrated structure. For facilitating actual installation, the former solution is used in this embodiment.

Figure 3:
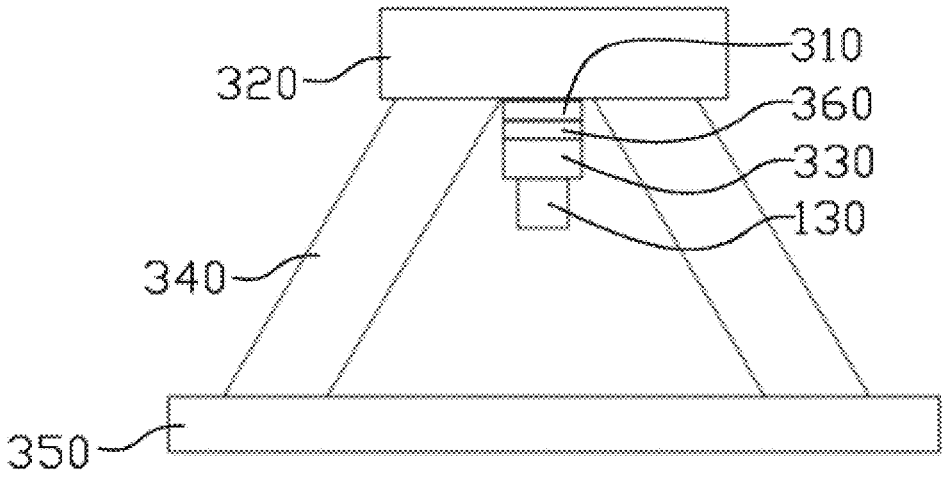
FIG. 3 is a front view of an embodiment of a second connecting portion according to the present invention.
Figure 4:
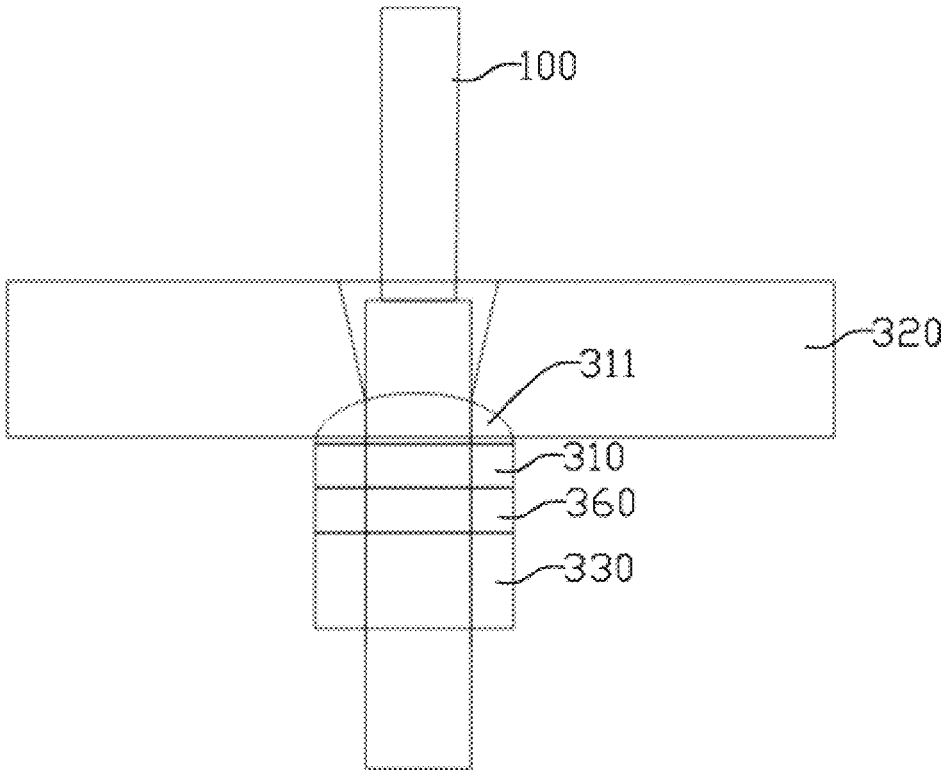
FIG. 4 is a section view of a second connecting portion and a cable connecting portion according to the present invention.

Referring to FIG. 3 and FIG. 4, FIG. 3 is a front view of an embodiment of a second connecting portion according to the present invention, and FIG. 4 is a section view of a second connecting portion and a cable connecting portion according to the present invention. As shown in the figures, the second connecting portion includes a spherical hinge cushion block 310, an anchoring beam 320, an anchoring nut 330, an anchor support 340, and a pre-embedded anchoring element 350, where the spherical hinge cushion block 310, the anchoring beam 320, and the anchoring nut 330 form a spherical hinge assembly, the cable 100 can rotate, by using the spherical hinge assembly, along multiple directions relative to the second connecting portion. Specifically, the anchoring beam 320 is provided with a through hole, one end of the through hole forms a taper hole, the taper hole allows the cable 100 to swing in a specific range, and the other end of the through hole forms an arc-shaped groove. The spherical hinge cushion block 310 is provided with an arc-shaped protrusion 311 matching a curvature diameter of the groove, an end part of the cable 100 is inserted from the taper hole and is connected to the spherical hinge cushion block 310 after passing through the through hole, and the protrusion is embedded into the groove to form the spherical bearing pair. In this way, the cable can rotate along multiple directions relative to the second connecting portion.

In this embodiment, the anchoring nut 330 is preferably used to connect the cable and the spherical hinge cushion block. Specifically, the spherical hinge cushion block 310 is also provided with a through hole, the end part of the cable 110 extends out from the through hole, and the anchoring nut 330 is directly connected to an extending end of the hanger, or is connected to a screw anchor cup sleeved out of the extending end of the cable, so as to clamp the spherical hinge cushion block between the cable and the anchoring beam 320. In a replacement process of the cable, the anchoring nut 330 gradually releases tension of the cable with no need of a complex construction process such as disposing an auxiliary hanger. This facilitates shortening of a construction period and has a better economic effect. In addition, to adapt tensioning of the cable, the anchoring nut 330 may alternatively be screwed in or out to adjust a spacing between the first connecting portion 200 and the second connecting portion 300.

Certainly, the cable may alternatively be connected to the spherical hinge cushion block by using another well-known technology.

The second connecting portion further includes a pressure sensor 360, and the pressure sensor 360 is disposed between the anchoring nut 330 and the spherical hinge cushion block 310, and is configured to detect pressure of the cable.

The anchor support 340 and the pre-embedded anchoring element 350 form a connecting assembly of the second connecting portion, where the anchor support 340 is configured to connect the pre-embedded anchoring element 350 to the anchoring beam 320, and the pre-embedded anchoring element 350 is configured to connect the second connecting portion to the bridge.

The connecting assemblies in the present invention are not limited to the foregoing two connecting assemblies. Different assemblies may be selected as required as the first connecting portion and the second connecting portion. The foregoing two connecting assemblies are used as examples. Both the first connecting portion and the second connecting portion use the pre-embedded anchoring element for connection, or are connected to the hoop steel plate by using the steel ring.

Figure 5:
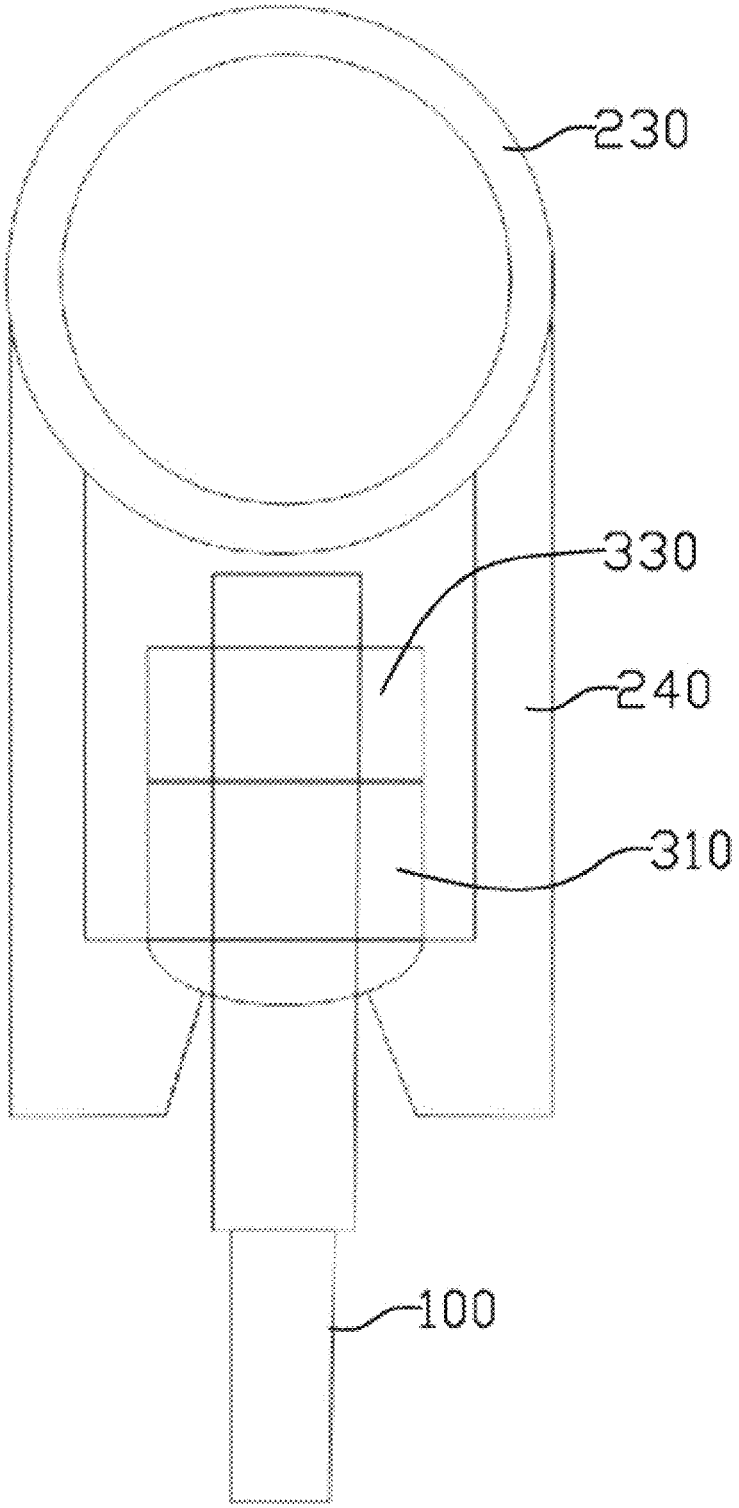
FIG. 5 is a front view of another embodiment of a first connecting portion according to the present invention.

In the foregoing embodiment in the present invention, the first connecting portion can rotate only along one direction. However, for a stay cable or special-shaped arch bridge, when an inclined cable plane appears outside a plane, deformation of the cable may be bi-directional. On this basis, the present invention further discloses a second embodiment of the first connecting portion. Referring to FIG. 5, the steel ring 230 and the hoop steel plate 240 are located above the second connecting portion, the spherical hinge cushion block 310 and the anchoring nut 330 are located below the second connecting portion, the top end of the cable 100 forms the spherical hinge assembly together with the spherical hinge cushion block 310, the anchoring nut 330, and the hoop steel plate 240. In this way, the top end and the bottom end of the cable can rotate along multiple directions, so as to further improving safety of the cable.

Figure 6:
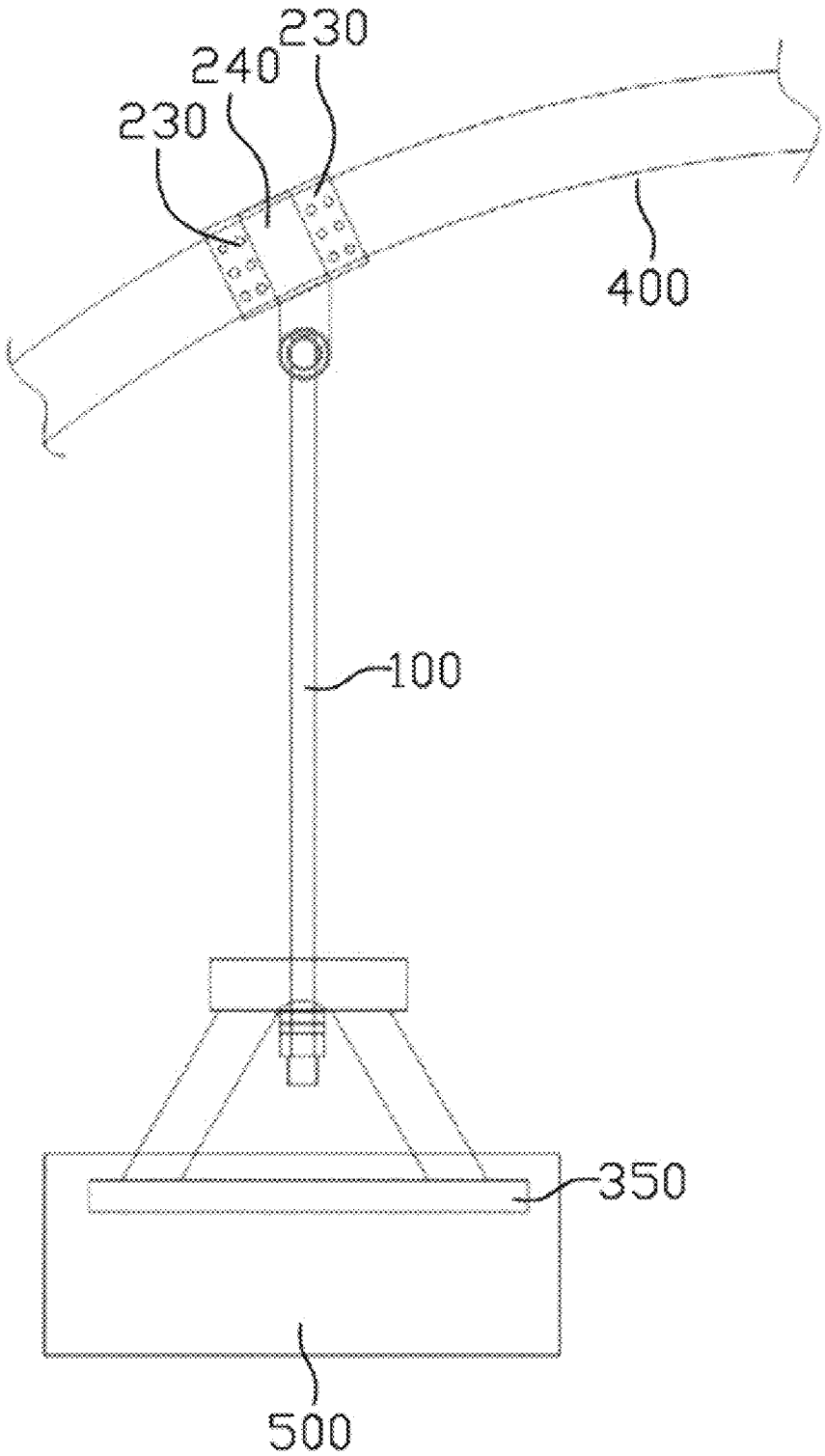
FIG. 6 is a front view of an embodiment of a bridge structure according to the present invention.

Referring to FIG. 6, the present invention further discloses a bridge structure to which the foregoing cable connecting structure is applied, including an arch rib 400 and a beam 500. To adapt the bridge structure, the cable connecting structure uses the structure shown in FIG. 1, that is, a first connecting portion is a connecting assembly formed by using a steel ring and a hoop steel plate, a second connecting portion uses a pre-embedded anchoring element, a bottom end of a cable is directly pre-embedded inside the beam 500 by using the pre-embedded anchoring element, and a top end thereof is sleeved on the arch rib 400 by using the steel ring and the hoop steel plate, and the steel ring and the arch rib are fixed as a whole by using several radial rivets.

In the present invention, by using a hinge assembly and a spherical hinge assembly, a rotatable connection between the cable and a bridge structure is implemented, so as to avoid force uniformity of steel wires inside the cable caused due to incline and deformation of the cable, and help to prolong the service life of the cable; the connecting ends of the cable are located in a lower part of an arch rib and an upper part of a bridge floor, respectively, and are located within a line of sight range, and therefore, it is convenient for maintenance, and a blind zone of maintenance can be eliminated, thereby greatly improving safety of a bridge; and the cable and connecting assemblies can be prefabricated in a factory, and therefore, construction quality can be ensured, and time of site construction can be reduced, so as to help to shorten a construction period and improve efficiency.

The foregoing provides detailed descriptions of preferred embodiments of the present invention, but the present invention is not limited to the embodiments. Persons skilled in the art can still make various equivalent variations or replacements without departing from the spirit of the present invention. All these equivalent variations or replacements fall within the scope defined by the claims in this application.

What is claimed is:

1. A flexible cable connecting structure, comprising: a flexible cable; a first connecting portion connected to a top end of the flexible cable; and a second connecting portion connected to a bottom end of the flexible cable, wherein:

the cable is rotatably connected to the first connecting portion and the second connecting portion, and is connected to at least one of the first connecting portion and the second connecting portion by using a spherical bearing pair;

the first connecting portion comprises a hinge assembly rotating along one direction or a spherical hinge assembly rotating along multiple directions, and the second connecting portion comprises a spherical hinge assembly rotating along multiple directions; and the spherical hinge assembly comprises a spherical hinge cushion block and an anchoring beam, the anchoring beam is provided with a through hole, one end of the through hole comprises a taper hole, the other end of the through hole comprises a groove, the spherical hinge cushion block is provided with an arc-shaped protrusion matching a curvature diameter of the groove, an end part of the cable is inserted from the taper hole and is connected to the spherical hinge cushion block after passing through the through hole, and the protrusion is embedded into the groove to form the spherical bearing pair.

2. The flexible cable connecting structure according to claim 1, comprising an anchoring nut, wherein an end part of the cable is provided with a screw anchor cup, the screw anchor cup passes through the spherical hinge cushion block, and the anchoring nut is in threaded connection with the screw anchor cup.

3. The flexible cable connecting structure according to claim 2, comprising a pressure sensor, wherein the pressure sensor is disposed between the anchoring nut and the spherical hinge cushion block.

4. The flexible cable connecting structure according to claim 1, wherein the cable comprises a steel strand and a protective casing disposed outside the steel strand.

5. The flexible cable connecting structure according to claim 4, wherein a screw anchor cup is sleeved outside an end part of the cable, and an annular seal ring is disposed between the screw anchor cup and an outer wall of the protective casing.

6. The flexible cable connecting structure according to claim 1, wherein the first connecting portion and the second connecting portion each comprise a connecting assembly, and the connecting assembly comprises a pre-embedded anchoring element, or the connecting assembly comprises a steel ring.

7. The flexible cable connecting structure according to claim 6, wherein the connecting assembly of the first connecting portion comprises the pre-embedded anchoring element, the connecting assembly of the second connecting portion comprises the steel ring and a hoop steel plate, and the steel ring is disposed at two ends of the hoop steel plate, and is coaxial with the hoop steel plate.

8. A bridge structure, comprising an arch rib and a beam, and further comprising the flexible cable connecting structure according to claim 7, a bottom end thereof is pre-embedded inside the beam by using the pre-embedded anchoring element, a top end thereof is sleeved on the arch rib by using the steel ring and the hoop steel plate, so that an anchoring end of the cable is within a visual range, and the steel ring and the arch rib are fixed as a whole by using several rivets.

* * * * *